US006694544B2

(12) United States Patent
Piatt

(10) Patent No.: US 6,694,544 B2
(45) Date of Patent: Feb. 24, 2004

(54) CABINET SPOUT ASSEMBLY

(75) Inventor: James M. Piatt, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/283,382

(22) Filed: Oct. 28, 2002

(65) Prior Publication Data

US 2003/0079282 A1 May 1, 2003

Related U.S. Application Data

(60) Provisional application No. 60/346,019, filed on Oct. 26, 2001.

(51) Int. Cl.[7] ..... E02C 1/04
(52) U.S. Cl. ..... 4/661; 4/675
(58) Field of Search ..... 4/619, 638, 670, 4/675–678; 312/209, 227, 229

(56) References Cited

U.S. PATENT DOCUMENTS

| | | | | |
|---|---|---|---|---|
| 1,259,873 A | | 3/1918 | Kaplan | |
| 1,380,222 A | | 5/1921 | Lichtenberg | |
| 1,719,386 A | | 7/1929 | Bence | |
| 1,745,209 A | | 1/1930 | Donovan | |
| 2,254,431 A | | 9/1941 | Levine | |
| 2,553,965 A | | 5/1951 | Gist | |
| 4,334,723 A | * | 6/1982 | Grunert | 312/209 |
| 5,590,940 A | | 1/1997 | Richard | |
| 6,059,388 A | | 5/2000 | Wheatley, Jr. | |

* cited by examiner

*Primary Examiner*—Charles E. Phillips
(74) *Attorney, Agent, or Firm*—George E. Haas; Quarles & Brady LLP

(57) ABSTRACT

A medicine cabinet for mounting on a wall above a sink includes a cabinet frame and a door pivotally attached to the front of the cabinet frame. A mirror is attached to the exterior surface of the door and has an aperture there through. A shelf assembly slidably extends through the side opening of the cabinet frame, and has a first position in which the shelf assembly is received within the first cavity and a second position in which the shelf assembly projects outwardly from a side of the cabinet frame. A spout passage extends through the aperture in the mirror and emits a stream of water. A control valve can be mounted to the cabinet frame to control the flow of water from a supply to the spout.

22 Claims, 3 Drawing Sheets

CABINET SPOUT ASSEMBLY

CROSS-REFERENCE TO RELATED APPLICATIONS

This application claims benefit of U.S. Provisional Patent Application No. 60/346,019 filed Oct. 26, 2001.

STATEMENT REGARDING FEDERALLY SPONSORED RESEARCH OR DEVELOPMENT

Not Applicable

BACKGROUND OF THE INVENTION

1. Field of the Invention

The present invention relates to plumbing fittings, and more particularly to a spout mountable in a medicine cabinet or the like to deliver a stream of water into a lavatory or a sink.

2. Description of the Related Art

A conventional lavatory has a depressed basin with a drain opening at the bottom that is connected to the waste water pipe of the building in which the lavatory is located. The lavatory is typically supplied with water from a faucet that is mounted on either a rim of the lavatory or a counter adjacent the lavatory. In some applications, a spout projects through a room wall, with a control valve mounted elsewhere on the wall (e.g. a tub filler and shower control). However, that disrupts the wall surface, and is somewhat expensive to install and maintain.

It is also conventional to provide a cabinet, commonly referred to as a "medicine cabinet", mounted to a bathroom wall above and behind a lavatory (or elsewhere in the bathroom). A mirror is attached to the front of many such medicine cabinets, so that a person can observe his or her face while using the lavatory. In one form of the cabinet, the mirror is attached to a door that is pivotably connected by hinges to the frame of the cabinet. In another type of medicine cabinet, the mirror is divided into sections, each sliding laterally in a bypass configuration past one another in horizontal tracks. The interior of the cabinet has a plurality of shelves for holding toiletries, medicine and other items. It is also known to mount mirrors separately on bathroom walls.

However, it is believed that to date a spout not previously been associated with the medicine cabinet has always been used to supply a lavatory. This has certain disadvantages from an aesthetic standpoint, and may use up extra space.

SUMMARY OF THE INVEMTION

The present invention pertains to a spout assembly for emitting a stream of liquid. There is a support structure, a mirror attached to the support structure and having an aperture, and a spout passage extending through the aperture in the mirror. There may be a cabinet frame and a door pivotably attached to the cabinet frame, with the mirror being attached to the door.

In one aspect there can be a cabinet frame with a rear face for attachment to a structural member of the building, a front face, a side opening, a first cavity, and a second cavity. The mirror extends across the front face of the cabinet frame, and is mounted on a door that is pivotally attached to the cabinet frame and extends across the front face in a closed state. A spout passage communicates with the second cavity of the cabinet frame in which the plumbing connections are made. For example, a valve with an external control handle extends into the second cavity to control the stream of water from the spout.

Another aspect of the invention relates to a shelf assembly slidably extending through a side opening of the cabinet frame. In a first position, the shelf assembly is received within the cabinet (preferably behind the mirror), and in a second position the shelf assembly projects outwardly from the cabinet frame to allow access to the contents of the shelves. Alternately, a pair of such shelf assemblies can be provided to slide outward from opposite sides of the cabinet.

This type of construction is particularly desirable when there is a spout in the cabinet as the front door of the cabinet need only be opened for maintenance. Thus, the internal operation of the valving and conduits is hidden from view.

These and other advantages of the present invention will be apparent from the following description.

DETAILED DESCRIPTION OF THE INVENTION

Figure 1:
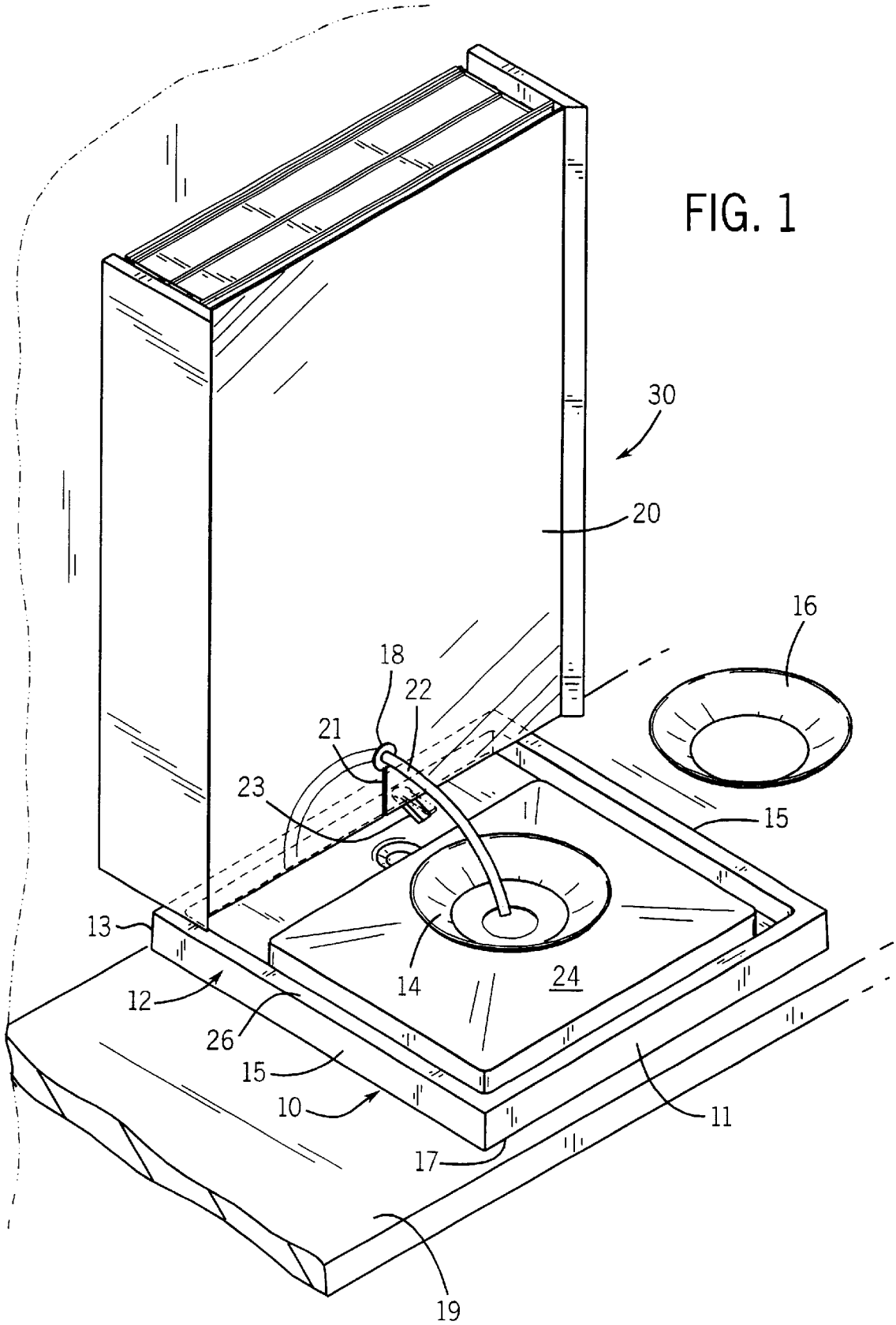
FIG. 1 is a is an isometric view of a lavatory and an associated wall cabinet having a water spout according to the present invention.

With initial reference to FIG. 1, a lavatory 10 comprises a platform 12 and first and second bowls 14 and 16, respectively. A water spout 18, located on a mirror 20, produces a stream of water 22 that flows in an arcuate path onto the lavatory platform 12. The stream of water 22 is emitted horizontally from the spout 18 (preferably as a laminar flow) and then curves substantially ninety degrees before striking the platform in a virtually downward direction.

A drip guide 21 is located between the spout 18 and the bottom edge of the mirror 20 to facilitate drips of liquid emanating from the spout to form a sheet flow. The drip guide 21 may be a vertical groove in the mirror or a piece of tape. Alternatively, the spout passage may be sufficiently upwardly sloped through the mirror to prevent dripping. The user controls the volume and temperature of the water by operating an essentially conventional valve control lever 23 that projects from beneath the mirror 20.

The lavatory platform 12 is generally rectilinear with front and rear walls 11 and 13, respectively, and two side walls 15. However, the platform may take the form of other geometric shapes. A bottom surface 17 of the platform rests on a counter 19. A drain connection of the platform 12 extends below the top of the counter 19. The upper portion of the platform 12 has a central work surface 24 surrounded by a trough 26. The work surface 24 is slightly crowned at the center and slopes toward the trough 26, so that the water from stream 24 flows in all directions to the edges of the work surface and into the trough.

It is further preferred that the trough 26 totally surround the work surface 24 as illustrated. A drain opening is located in the bottom surface of the trough 26 at the rear of the lavatory. The trough 26 is sloped so that water will flow by gravity toward that drain opening which is connected to a waste pipe for the room in which the lavatory is located. The rear section of the trough 26 is wider than the other sections in order to contain the volume of water flowing to the drain opening 28.

The two bowls 14 and 16 can be separately placed on the work surface 24 adjacent the spout 18 so that the water stream 22 fills the respective bowl. The bowls then may be moved to other locations on the work surface 24. Both bowls 14 and 16 can be placed on the work surface 24 simultaneously with one being filled with hot water and the other with cold water, or one with soapy water and the other with rinse water.

Figure 2:
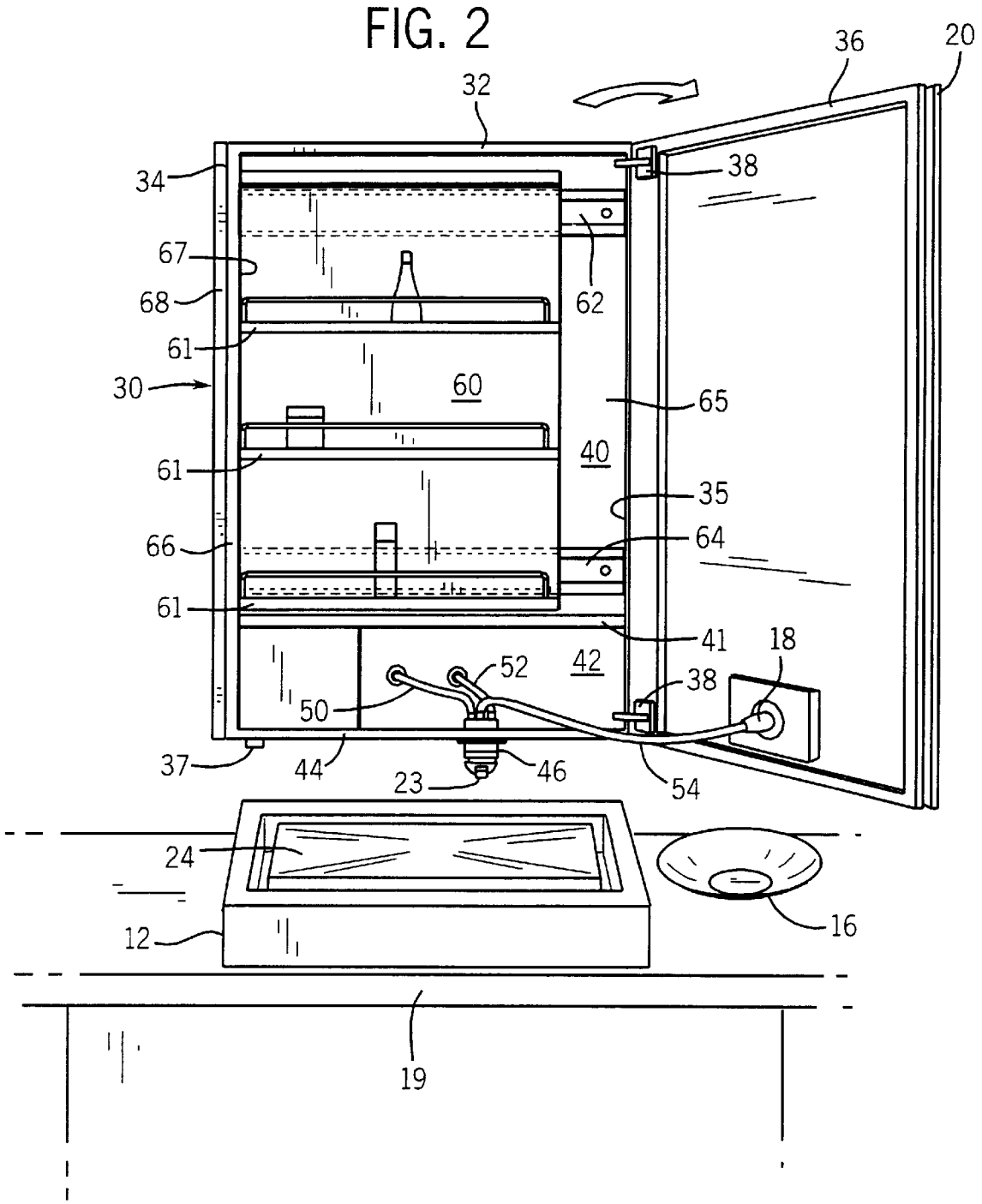
FIG. 2 shows the wall cabinet in FIG. 1 with a front access door open and shelves in a retracted position.

With reference to FIG. 2, a cabinet 30 has a frame 32 which attaches to the building wall behind the lavatory 10. The cabinet frame 32 has an open front and an open left side 34. The right side is closed by a panel 35 in the version of the cabinet illustrated in the drawings. Alternatively, the right side of the cabinet frame 32 can be open and the left side closed to provide shelf access on the opposite side of the cabinet 30, as will become apparent. Alternatively, two halves of such assemblies can be separately linked to side walls such that half of the width of the current shelf can be extended out each side.

A front door 36 is attached by hinges 38 to the cabinet frame 32 and the mirror 20 is attached to the exterior surface of the door 36. The mirror is a sheet of glass which is silvered on one major surface and the door serves as a mirror frame which supports the sheet of glass.

The cabinet frame 32 has an internal horizontal wall 41 dividing the frame's interior into an upper cavity 40 and a lower cavity 42 which is further defined by a bottom wall 44. A mixing valve 46 is mounted through an aperture in the bottom wall 44 with the control lever 23 extending outward from the front of the cabinet for operation by the user to control the flow rate and temperature of the water flowing through spout 18. Hot and cold water supply lines 50 and 52 enter from the building wall behind the cabinet 30 and connect to the mixing valve 48.

A flexible hose 54 connects the outlet of the mixing valve 48 to an inlet fitting of the spout 18 on the rear side of the door 36. The spout passage 18 extends through the mirror 20 and the door 36 which supports the mirror. The door 36 is used only to service the plumbing components and in normal operation is secured by a latch 37 so that the user is discouraged from opening it.

The upper cavity 40 of the cabinet 30 receives a shelf assembly 60 which slides laterally on a pair of conventional drawer slides 62 and 64 mounted horizontally on the rear wall 65 of the cabinet frame 32. The drawer slides 62 and 64 comprise two elements, one slidably received in the other, with wheels or spheres to aid the sliding action. One element is fixed to the interior surface of the frame's rear wall 65 and the other drawer slide element is attached to the rear surface of shelf assembly 60. The drawer slides 62 and 64 enable the shelf assembly to slide laterally within the cabinet frame 32 and through an opening 67 on the left side 34. This movement of the shelf assembly 60 is parallel to the cabinet's rear wall 65, and thus the wall of the building.

Figure 3:
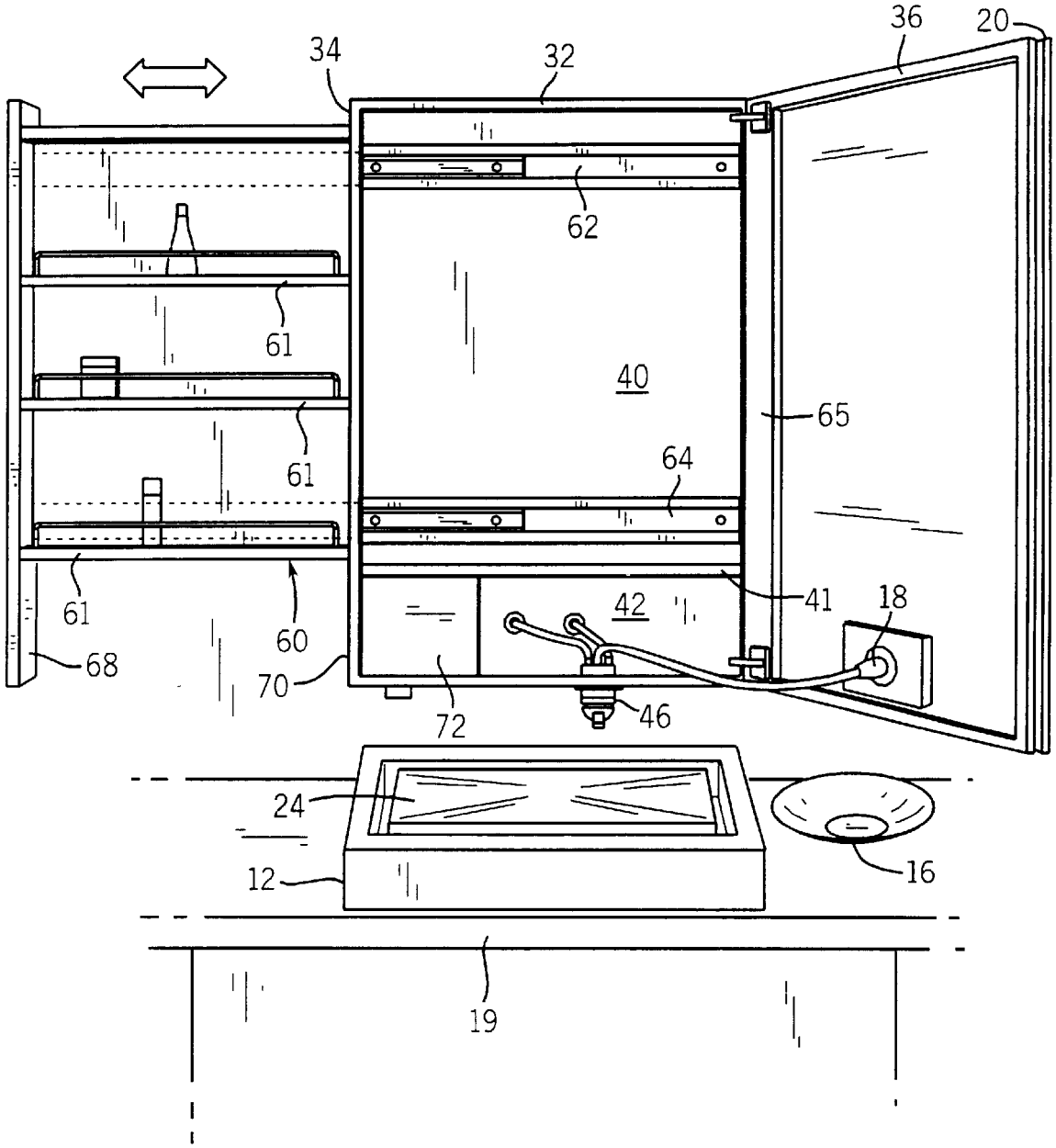
FIG. 3 illustrates the wall cabinet with a front access door open and the shelves extended laterally.

FIG. 2 illustrates the shelf assembly 60 retracted into the cabinet 30. In this position, the left ends of each shelf 61 of the assembly 60 protrude through the left side opening 67 that is formed between a front rail 66 and the rear wall 65. The shelves 61 are connected to an exterior left panel 68 that closes the side opening 67. The user is able to grasp a left panel 68 and pull the shelf assembly 60 along the slides 62 and 64 thereby extending the shelf assembly from the cabinet frame 32 as shown in FIG. 3.

Extending the shelf assembly 60 from the left side of the cabinet frame 32 allows the user to access the items stored on the shelves 61 of the shelf assembly 60. Recall that the front door 36, being secured in the closed position, normally is opened only to service the plumbing components and not to access the shelves 61.

The shelf assembly 60 does not slide into the lower cavity 42 of the cabinet frame 32. The side panel 68 extends downward to cover the entire left side of the cabinet frame when the shelf assembly is in the retracted position. The left section of the lower cavity 42 is enclosed by a front wall 72 which conceals wiring of an electrical outlet (not visible) located on wall 70 at the lower section of the frame 32. Thus, when the shelf assembly 60 is pulled out of the cabinet frame 32, the electrical outlet is exposed and is otherwise hidden from view by the side panel 68 when the shelf assembly is retracted.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. For example, the invention has been described for use with a bathroom lavatory, but one skilled in the art will recognize that this novel concept can be used elsewhere. Accordingly, the scope of the invention should be determined from the following claims and not limited by the above disclosure.

INDUSTRIAL APPLICABILITY

The present invention provides storage cabinets for use in bathrooms and the like that also can deliver a supply of water in a controlled manner.

The foregoing description was primarily directed to preferred embodiments of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

I claim:

1. A spout assembly for emitting a stream of liquid comprising:

a support structure;

a mirror attached to the support structure and having an aperture; and a spout passage extending through the aperture in the mirror.

2. The assembly as recited in claim 1, wherein the support structure comprises a cabinet frame and a door pivotally attached to the cabinet frame, the mirror being attached to the door.

3. The assembly as recited in claim 1, wherein the support structure comprises a cabinet to which the mirror is attached.

4. The assembly as recited in claim 3, further comprising a valve mounted to the cabinet and connected to the spout passage to control the stream of the liquid.

5. The assembly as recited in claim 3, wherein the cabinet comprises a cabinet frame for attachment to the structural member, and a shelf assembly received within the cabinet frame and slidable through an opening in the cabinet frame.

6. The assembly as recited in claim 1, wherein the support structure comprises: a cabinet frame for attachment to the structural member and having a first cavity, a second cavity, and an exterior opening into the first cavity, the mirror being coupled to the cabinet frame; and a shelf assembly extending through the exterior opening and being slidable with respect to the cabinet frame so as to have a first position in which the shelf assembly is received within the first cavity and a second position in which the shelf assembly extends outwardly from the cabinet frame.

7. The assembly as recited in claim 6, wherein the support structure further comprises a track along which the shelf assembly slides with respect to the cabinet frame.

8. The assembly as recited in claim 6, wherein the support structure further comprises a door pivotally attached to the cabinet frame, and the mirror is attached to the door.

9. The assembly as recited in claim 6, further comprising a valve mounted to the cabinet frame and extending into the second cavity, and a conduit in the second cavity connecting the valve to the spout passage.

10. A cabinet for use with a liquid receptacle, said cabinet comprising:

a cabinet frame for engaging a support and having a front and a side with an opening there through;

a shelf assembly received within the cabinet frame and slidable through the opening in the side of the cabinet frame;

a water spout passage extending through the front of the cabinet frame for emitting a stream of water into the liquid receptacle; and a mirror extending across the front of the cabinet frame and having an aperture which is a portion of the spout passage.

11. The cabinet as recited in claim 10, further comprising a valve mounted to the cabinet frame and connected to the spout passage for controlling the stream of water.

12. The cabinet as recited in claim 10, further comprising a door pivotally attached to the cabinet frame wherein the mirror is mounted on the door.

13. A cabinet, comprising:

a cabinet frame for attachment to a structural member of a building, and having a front face, a side opening, a first cavity, and a second cavity;

a mirror attached across the front face of the cabinet frame and having an aperture there through;

a spout passage extending through the aperture in the mirror for emitting a stream of water; and a shelf assembly slidably extending through the side opening of the cabinet frame, and having a first position in which the shelf assembly is received within the first cavity and a second position in which the shelf assembly extends outwardly from the cabinet frame.

14. The cabinet as recited in claim 13, further comprising:

a valve mounted to the cabinet frame, extending into the second cavity, and connected to a source of water; and a flexible conduit received in the second cavity when the door is in the closed state and connecting the valve to the spout passage.

15. The cabinet as recited in claim 13, further comprising a door pivotally attached to the cabinet frame and having a closed state in which the door extends across the front face of the cabinet frame, and wherein the mirror is attached to the door.

16. The cabinet as recited in claim 13, further comprising a conduit received in the second cavity and connecting the spout passage to a source of water.

17. A cabinet for hanging on a wall, the cabinet comprising:

a cabinet frame for attachment to a structural member of a building, a front face and a side opening, wherein the cabinet frame defines a cavity;

a mirror attached across the front face of the cabinet frame; and a shelf assembly extendable through the side opening and being slidable with respect to the cabinet frame, and having a first position in which the shelf assembly is received within the first cavity and a second position in which the shelf assembly extends outwardly from the cabinet frame.

18. The cabinet as recited in claim 17, further comprising a door pivotally attached to the cabinet frame and having a closed state in which the door extends across the front face of the cabinet frame, and wherein the mirror is attached to the door.

19. The cabinet as recited in claim 17, further comprising a spout passage extending through an aperture in the mirror to emit a stream of water.

20. The cabinet as recited in claim 17, further comprising a valve mounted to the cabinet frame and connected to a source of water; and a conduit connecting the valve to the spout passage.

21. The cabinet as recited in claim 19, wherein the mirror has a drain groove in its outer surface below the spout passage.

22. The cabinet as recited in claim 19, wherein the mirror has a tape mounted on its outer surface below the spout passage to facilitate sheeting of dripping liquid off the mirror.

* * * * *